United States Patent [19]

Cones

[11] Patent Number: 4,509,742

[45] Date of Patent: Apr. 9, 1985

[54] EXERCISE BICYCLE

[76] Inventor: Charles F. Cones, 124 S. Market St., Thorntown, Ind. 46071

[21] Appl. No.: 501,634

[22] Filed: Jun. 6, 1983

[51] Int. Cl.[3] ..... A63B 23/04; A63B 21/00

[52] U.S. Cl. ..... 272/73; 272/130; 138/45

[58] Field of Search ..... 272/73, 130; 128/25 R; 73/379; 280/217; 138/45, 46

[56] References Cited

U.S. PATENT DOCUMENTS

| | | | |
|---|---|---|---|
| 747,294 | 12/1903 | Blaisdell | 272/73 |
| 2,453,771 | 11/1948 | White | 128/25 R |
| 2,603,486 | 7/1952 | Hughes | 128/25 R |
| 2,825,563 | 3/1958 | Lawton | 272/130 |
| 3,432,164 | 3/1969 | Deeks | 272/73 |
| 3,494,616 | 2/1970 | Parsons | 272/73 |
| 3,784,194 | 1/1974 | Perrine | 272/130 |
| 3,822,599 | 7/1974 | Brentham | 272/130 |
| 4,188,030 | 2/1980 | Hooper | 272/73 |
| 4,291,787 | 9/1981 | Brentham | 272/130 |

*Primary Examiner*—Richard J. Apley
*Assistant Examiner*—S. R. Crow
*Attorney, Agent, or Firm*—Woodard, Weikart, Emhardt & Naughton

[57] ABSTRACT

An exercise bicycle including a flywheel assembly mounted on the driveshaft of an hydraulic pump and a load resistance control mechanism for variably controlling the load resistance on the hydraulic pump. A pressure gauge means is also provided to measure the pressure between the load resistance control mechanism and the hydraulic pump so as to serve as an indicator of work rate input. Each of the handlebars of the exercise bicycle is separately pivotally secured to the frame of the exercise bicycle. A linkage means connects the handlebars to the driveshaft in such manner that the driveshaft may be driven by pivotal movement of the handlebars or rotation of foot pedals mounted to the flywheel assembly.

10 Claims, 5 Drawing Figures

EXERCISE BICYCLE

BACKGROUND OF THE INVENTION

The present invention relates generally to the field of exercise bicycles or ergometers and, more particularly, to those devices which eliminate the need for brake pads or similar mechanical means for applying resistance to the flywheel.

The patent literature and market disclose many types of exercise bicycles, or ergometers, and means associated therewith for determining work output. However, conventional exercise bicycles such as are disclosed therein are characterized by either inaccurate or fairly complicated means for measuring work input.

A simple and commonly used design for exercise bicycles incorporates an adjustable friction brake mechanism in which the degree of tension applied by brake pads upon the flywheel is varied by rotating a control knob which is operatively connected to the brake pads by a caliper-type linkage. The degree of tensioning or load resistance cannot be accurately calibrated according to the positioning of the control knob, however, because as the brake pads become worn the control knob must be turned a relatively greater amount in order to attain the same degree of tensioning previously applied. Thus, the operator must continually guess where the control knob should be positioned to obtain the desired load resistance. This problem is not remedied by the fact that the exercise bicycle may be equipped with an indicator means for measuring work rate input, since this measurement is dependent upon both load resistance and rate of pedaling. Hence, the operator may still be unable to adjust the resistance load to the desired setting.

Also, previous work rate input indicators have themselves been characterized by relatively inaccurate or complicated and expensive constructions. Thus, those that employ electronic circuitry or electrical motor/-generator means are disadvantaged by their expense, while mechanical devices, such as those employing spring tensioning means are often inaccurate or subject to breakdown and replacement of worn parts.

Another benefit not provided by any known types of exercise bicycles or ergometers concerns the ability to provide muscular exertion of the arms and upper body in addition to the lower torso and legs, and to permit measurement of the total work rate input provided by the muscular exertion of these body parts.

The following list of patent references disclose various types of exercise bicycles and ergometers:

| Patent No. | Inventor | Issued |
|---|---|---|
| | Group I | |
| 3,192,772 | Tarter | July 6, 1965 |
| 3,360,263 | Tsuru | December 26, 1967 |
| 3,845,663 | Blomberg et al. | November 5, 1974 |
| 3,995,491 | Wolfla, II | December 7, 1976 |
| 4,007,927 | Proctor | February 15, 1977 |
| 4,291,872 | Brilando et al. | September 29, 1981 |
| | Group II | |
| 2,784,591 | Shoor | March 12, 1957 |
| 3,767,195 | Dimick | October 23, 1973 |
| 3,802,698 | Burian et al. | April 9, 1974 |
| 3,845,756 | Olsson | November 5, 1974 |
| 3,984,666 | Barron | October 5, 1976 |
| 4,112,928 | Putsch | September 12, 1978 |

It may be noted that those patents falling in the first category all disclose mechanical tensioning means for applying variable resistance to a rotatable flywheel. The Wolfla and Tsuru patents disclose the use of a belt or strap wrapped around the circumference of the flywheel as the braking means while the other patents in this category employ brake pads or a drag roller as the adjustable braking means.

Those patents falling in the second category are grouped together for their disclosure of fairly sophisticated electronic means for measuring energy or work output. None of devices disclosed in these patents is characterized by the simplicity of the present invention.

Moreover, none of the above patents in either Group I or II above disclose an exercise bicycle which permits muscular exertion of both the legs and the arms of the operator.

SUMMARY OF THE INVENTION

One embodiment of the exercise bicycle of the present invention comprises a frame and a positive displacement hydraulic pump mounted on the frame, the pump having a pair of inlet/outlet passages and a driveshaft for operating the pump. There is further provided a pair of foot pedals connected to the driveshaft of the pump for rotating the driveshaft. A load resistance control means is also provided which is operatively connected to the pump for variably controlling the load resistance on the hydraulic pump. The load resistance control means defines a valve body and valve seat in flow communication with the inlet/outlet passages. In addition, a gauge means is also provided between the pump and the load resistance control means, the gauge means serving to indicate work rate input of an operator actuating said exercise bicycle.

Accordingly, it is an object of the present invention to provide an improved exercise bicycle.

Further objects and advantages of the present invention will become more apparent by reference to the following figures and detailed description.

DESCRIPTION OF THE PREFERRED EMBODIMENT

Figure 4:
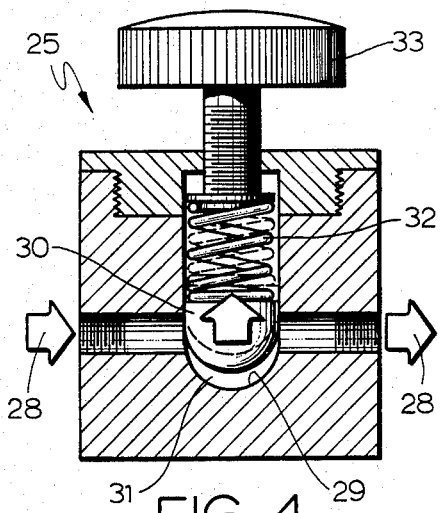
FIG. 4 is an enlarged fragmentary section view of the load resistance control valve of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, the preferred embodiment of the exercise cycle of the present invention is generally designated at 10. Exercise bicycle 10 generally includes a stationary support frame 11 on which is mounted an adjustable seat 12 of conventional design, an hydraulic pump 13 mounted on frame 11 between a pair of flywheels 16 rotatable by actuation of pedals 18, a load resistance control valve 25 operably connected to hydraulic pump 13, and a pair of handlebars 20, pivotally mounted separately on frame 11 and connected by a linkage arrangement to pedals 18.

Figure 2:
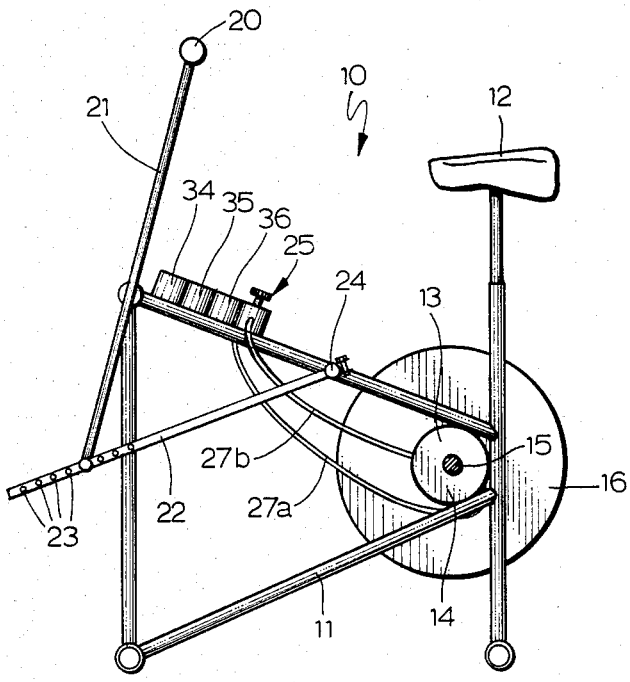
FIG. 2 is an elevation view of the exercise bicycle of FIG. 1, but having the handlebars rigidly attached to the frame, one of the pair of flywheels having been removed to show internal features.
Figure 3:
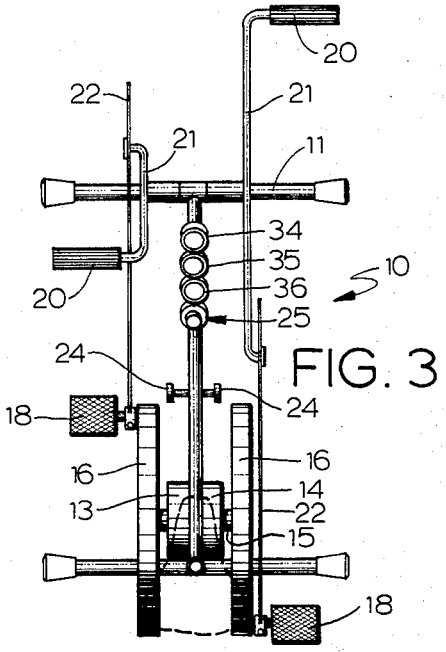
FIG. 3 is a top plan view of the exercise bicycle of FIG. 1, but showing the position of the handlebars with the pedals rotated approximately 180 degrees from the position in FIG. 1.
Figure 5:
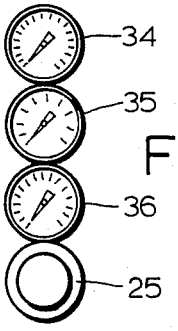
FIG. 5 is an enlarged top plan view of the instrument control panel used in the present invention.

As will be more clearly perceived by reference to FIGS. 2 and 3, hydraulic pump 13 includes a housing 14 rigidly secured to frame 11 and a driveshaft 15 extending axially through opposite sides of pump housing 14. Hydraulic pump 13 may be any type of positive displacement hydraulic pump, such as for example, a gear pump.

A pair of fly wheels 16 are mounted on driveshaft 15 on opposite sides of pump housing 14. Each one of a pair of foot pedals 18 is mounted on a different one of flywheels 16. A number of spaced apart mounting locations 19 are provided on each of the flywheels 16 for adjusting the distance between pedals 18 on flywheels 16. Thus, the diameter of rotation of pedals 18 may be varied for persons of different heights. Flywheels 16 serve to provide a stabilizing effect to the operation of bicycle exerciser 10 during use and also provide inertia to overcome deadspots in the movement of pedals 18 and handlebars 20.

Each one of the pair of handlebars 20 is integrally formed with and extends from the upper end of a stem 21 pivotally mounted on frame 11 at an intermediate point along its length. Each of the stems 21 pivot in a vertical plane and are attached at their respective lower ends to a link rod 22 pivotally mounted to one of pedals 18. Link rods 22 are provided with a plurality of apertures 23 so that the linkage between handlebars 20 and fly wheel 16 may be adjusted. Actuation of handlebars 20 thus serves to pivot stems 21 and thereby rotate flywheels 16, providing muscular exertion of the upper body and arms of an operator as well as the lower torso and legs. Frame 11 is also provided with a pair of mounting studs 24 which serve as a means for rigidly securing handlebars 20 in a locked position, such as is depicted in FIG. 2. This is accomplished by disconnecting link rods 22 from pedals 18 and securing the rearward ends of link rods 22 to mounting studs 24.

Load resistance control valve 25, illustratively shown in FIG. 4, is mounted in a convenient location on frame 11 and operatively connected to a pair of inlet/outlet passages in hydraulic pump 13 by inlet and outlet liquid flow lines **27*a* and 27*b*, respectively. It is to be understood that load resistance control valve 25 may be any conventionally known and suitable type of pressure control valve which limits the fluid pressure ahead of the valve to a desired amount despite varying flow rates. Arrows 28 indicate the flow of liquid through load resistance control valve 25 when flywheels 16 rotate in the direction shown in FIG. 1. Load resistance control valve 25 includes a valve body 29 and valve seat 30 defining an orifice or flow passageway 31 normally closed by seating of valve seat 30 against the valve body 29 under the urging of spring 32. A control knob 33 is provided at the upper end of spring 32 to control the bias on spring 32 by screw movement, the threads on control knob 33** being sized to provide fine adjustment of the spring bias.

Load resistance control valve 25 operates as follows. As an operator begins actuating exercise bicycle 10, liquid pressure in line **27*b* builds until it overcomes the bias in spring 32. The pressure cannot increase beyond the amount needed to overcome the spring bias since valve seat 30 will be urged away from valve body 29 in the direction indicated in FIG. 4. Thus, increasing the RPMs of driveshaft 15 results in an increase in the size of the flow passageway through load resistance control valve 25** which compensates against any further pressure increase.

Mounted adjacent to load resistance control valve 25 on frame 11 is a series of instruments including timer 34, speed indicator 35, and work rate indicator 36. Each of these indicators is located medially of handlebars 20 on frame 11 in serial fashion such that they are easily visible to an operator during use. Timer 34 may be of any conventionally known type, while speed indicator 35 is operably connected to the flywheels or driveshaft in a conventionally known manner in order to serve as a speed or RPM indicator. Work rate indicator 36 is operably connected to a pressure gauge means which, while not shown, is understood to be connected in flow communication between the outlet of hydraulic pump 13 and the inlet of valve body 29. The pressure gauge means may be of any conventionally known and suitable type. Since the pressure behind the valve body inlet 29 varies directly with work load, measuring pressure gives an accurate indication of the work load. In order to provide the operator with an indication of work rate input, a desirable rpm level is selected and work rate indicator 36 is calibrated so as to display the work rate input in units of work rate, such as foot-pounds per minute. It should be noted that a more sophisticated alternative embodiment of work rate indicator 36 could also be employed which would not require constant RPMs at a particular level be maintained to accurately indicate work rate input.

The operation of bicycle exerciser 10 may be described as follows. If the operator desires to exercise the upper body and arms as well as the legs, link rods 22 are attached to pedals 18 in the manner shown in FIG. 1. The desired amount of work rate input is set by first attaining the predetermined RPMs for which work rate indicator 36 is calibrated and then adjusting control knob 33 until the desired level of work rate is displayed on work rate indicator 36. If it becomes desirable to change the level of work rate input to another level, it is only necessary to maintain the RPMs constant while adjusting control knob 33 until the desired new level is indicated on work rate indicator 36.

Figure 1:
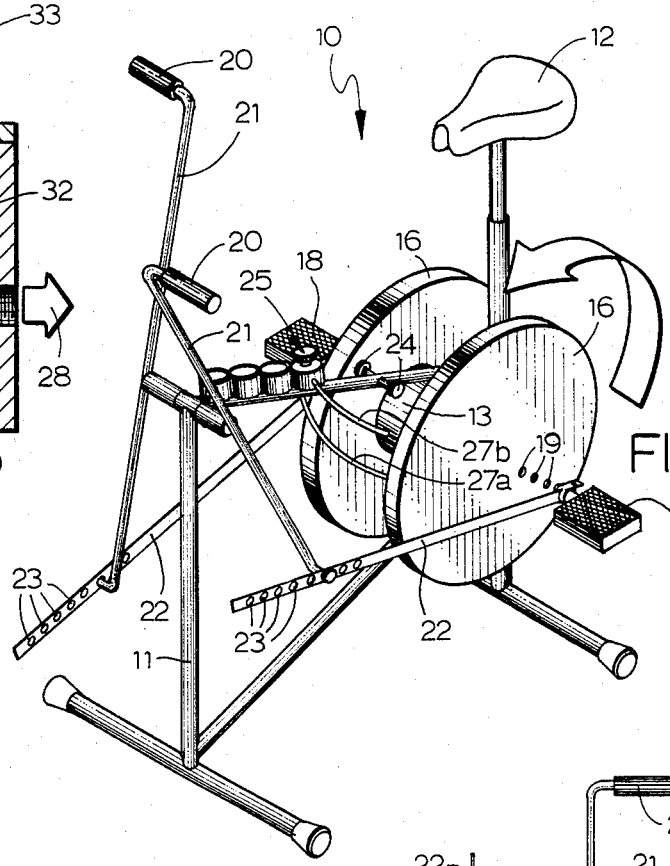
FIG. 1 is a perspective view of the preferred embodiment of the exercise bicycle of the present invention showing the handlebars linked to the pedals for cooperative movement therewith.

Actuation of hydraulic pump 13 is accomplished by pivotal movement of handlebars 20 in opposite directions or rotating pedals 18, or a combination of both. Movement of handlebars 20 with respect to pedals 18 may be described as follows. When the left handlebar 20 is in its furthest forward position, the right handlebar 20 will be in its rearmost position. The linkage between each of the handlebars 20 and pedals 18 is arranged such that when either one of handlebars 20 is in a forward position the corresponding one of pedals 18 would be generally rearwardly disposed. This is the arrangement that is depicted in FIG. 1. FIG. 3 shows that when left handlebar 20 is rearwardly disposed, left foot pedal 18 is generally forwardly disposed, while right handle bar 20 is in a forward position and right foot pedal 18 is rearwardly disposed. It should be noted at this point that while there are dead spots in the action of both handlebars 20 and pedals 18, this is compensated for by the inertia provided by flywheels 16. If it is desired that only foot pedals 18 be operable to actuate driveshaft 15, link rods 22 may be simply disconnected from their corresponding pedals 18 and attached to mounting studs 24, thus rigidly securing the position of handlebars 20.

It may be appreciated that bicycle exerciser 10 of the present invention eliminates the need for brake pads or friction straps in order to control the load resistance by employing a flow control valve arrangement in combination with an hydraulic pump. This is a distinct advantage since it is easily appreciated that load resistance control valve 25 is much less subject to wear than are brake pads or similar type friction means. Thus, the level of load resistance can be accurately set and maintained at a particular load setting over long periods of use. Further, because load resistance control valve 25 is less subject to wear, it has a longer useful life, resulting in less frequent replacement of parts. In addition, the use of hydraulic pump 13 eliminates the need for sprockets and chains such as are commonly used in previous style exercise bicycles. Also, since the system is hydraulically actuated, work rate input into this system may be simply and accurately measured by using a pressure gauge, thereby eliminating the need for any sophisticated electronic control means to accurately indicate work rate input.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An exercise bicycle, comprising:

a frame;

a positive displacement hydraulic pump mounted on said frame, said pump having a pair of inlet/outlet passages and a driveshaft for operating said pump;

a pair of foot pedals connected to said driveshaft of said pump for rotating said driveshaft;

a load resistance control means operatively connected to said pump for selectively controlling the load resistance on said hydraulic pump and automatically maintaining said load resistance constant at varying speeds of said driveshaft, said control means defining a valve body and valve seat in flow communication with said inlet/outlet passages; and a hydraulic pressure gauge means in fluid communication with said pump and said load resistance control means, said hydraulic pressure gauge means serving to indicate work rate input of an operator actuating said exercise bicycle.

2. The exercise bicycle of claim 1 wherein said load resistance control means includes a spring for adjustably biasing said valve seat in a normally closed position against said valve body.

3. The exercise bicycle of claim 2 wherein said hydraulic pump is a positive displacement gear pump.

4. The exercise bicycle of claim 2 and further comprising:

a pair of flywheels mounted on said driveshaft on opposite sides of said pump and rotatable with said driveshaft, one of said pedals mounted on each of said flywheels.

5. The exercise bicycle of claim 1 wherein said frame includes a pair of handlebars separately pivotally secured to said frame, and said exercise bicycle further comprises:

a linkage means between each of said pedals and said handlebars, said linkage means permitting said driveshaft to be rotated by pivotal movement of said handlebars in opposite directions.

6. The exercise bicycle of claim 5 and further comprising:

a locking means for rigidly securing said linkage means to said frame thereby rigidly securing said handlebars wherein said linkage means is releasably connected between said pedals and said driveshaft and said frame includes locking means for rigidly securing said handlebars to said frame.

7. The exercise bicycle of claim 6 wherein the position of said pedals on said flywheels is adjustable in order to vary the diameter of rotation of said pedals.

8. An exercise bicycle, comprising:

a frame including a pair of handlebars separately pivotally secured to said frame and operable in pivoting and stationary modes;

a flywheel rotatably mounted on said frame;

a pair of foot pedals actuable by an operator to rotate said flywheel;

a load resistance control means operatively connected to said flywheel for variably controlling the load resistance on said flywheel;

a linkage means releasably linking said flywheel and each of said handlebars, said linkage means for permitting said flywheel to be rotated by pivotal movement of said handlebars; and a locking means for rigidly securing said linkage means to said frame thereby rigidly securing said handlebars in said stationary mode.

9. The exercise bicycle of claim 8 wherein said foot pedals are connected to said flywheel and rotatable therewith.

10. The exercise bicycle of claim 9 and further comprising:

a gauge means for indicating work rate input of said operator in operating said exercise bicycle by pivoting said handlebars and rotating said pedals, said gauge means operatively connected between said flywheel and said load resistance control means.

* * * * *